US005600924A

United States Patent [19]

Forsberg

[11] Patent Number: 5,600,924

[45] Date of Patent: Feb. 11, 1997

[54] STEEL FRAME BUILDING

[76] Inventor: Gordon L. Forsberg, 8750-11 Gladiolus Dr.-#175, Fort Myers, Fla. 33908

[21] Appl. No.: 396,514

[22] Filed: Mar. 1, 1995

[51] Int. Cl.[6] ..... E04B 7/04

[52] U.S. Cl. ..... 52/93.2; 52/93.1; 52/276; 52/278

[58] Field of Search ..... 52/93.1, 93.2, 52/712, 278, 279, 276

[56] References Cited

U.S. PATENT DOCUMENTS

| | | | |
|---|---|---|---|
| 1,258,408 | 3/1918 | Hill . | |
| 1,893,636 | 1/1933 | Ridgeway . | |
| 2,085,472 | 6/1937 | Roush | 52/276 X |
| 3,146,864 | 9/1964 | Nystrom et al. | 52/93.2 |
| 3,979,862 | 9/1976 | Hamilton et al. | 52/93.2 |
| 4,455,792 | 6/1984 | Pasco | 52/93.2 |
| 4,551,957 | 11/1985 | Madray . | |
| 4,616,453 | 10/1986 | Sheppard, Jr. et al. | 52/93.1 |
| 4,648,216 | 3/1987 | Reaves et al. | 52/93.1 |
| 4,688,358 | 8/1987 | Madray . | |
| 4,697,393 | 10/1987 | Madray . | |
| 4,809,480 | 3/1989 | Hale . | |
| 4,894,964 | 1/1990 | Thrift et al. | 52/90 |
| 5,133,162 | 7/1992 | Nelson | 52/93.1 |
| 5,419,089 | 5/1995 | Hill | 52/93.2 |

FOREIGN PATENT DOCUMENTS

| | | | |
|---|---|---|---|
| 412259 | 6/1946 | Italy | 52/93.2 |
| 131393 | 4/1978 | Netherlands | 52/712 |
| 572134 | 1/1976 | Switzerland | 52/93.2 |
| 1416519 | 12/1975 | United Kingdom | 52/93.1 |
| 2012331 | 7/1979 | United Kingdom | 52/93.2 |

*Primary Examiner*—Carl D. Friedman
*Assistant Examiner*—Aimee E. McTigue
*Attorney, Agent, or Firm*—Kokjer, Kircher, Bowman & Johnson

[57] ABSTRACT

A structure is provided with base platform connectors which may be mounted on concrete pilings and which may join multiple floor rafters. Corner columns are connected to the top of certain platform connectors. The corner columns include vertical beams having a modified C-shaped cross-section to allow the sheeting to be attached directly thereto. Each corner column includes two vertical beams affixed back-to-back with spacers therebetween. A knife plate projects from the top of each column and is received within a lower end of a rafter. Hip and valley rafters include support beams having a modified open C-shaped cross-section. Each support beam receives purlins which provide a flat surface on the top and bottom sides thereof for receiving sheeting. Main frame rafters and wall columns are provided between the hip and valley rafters and are formed from support beams having a straight C-shaped cross-section to receive the purlins and exterior studs. The straight structure of the columns allow the columns to fit into the exterior wall envelope. A ridge strut is provided along the peak of the structure and may be formed to allow for a ridge ventilator. A peak connector is located at the point of intersection between the rafters and ridge struts to combine the rafters and maintains smooth seams therebetween.

24 Claims, 5 Drawing Sheets

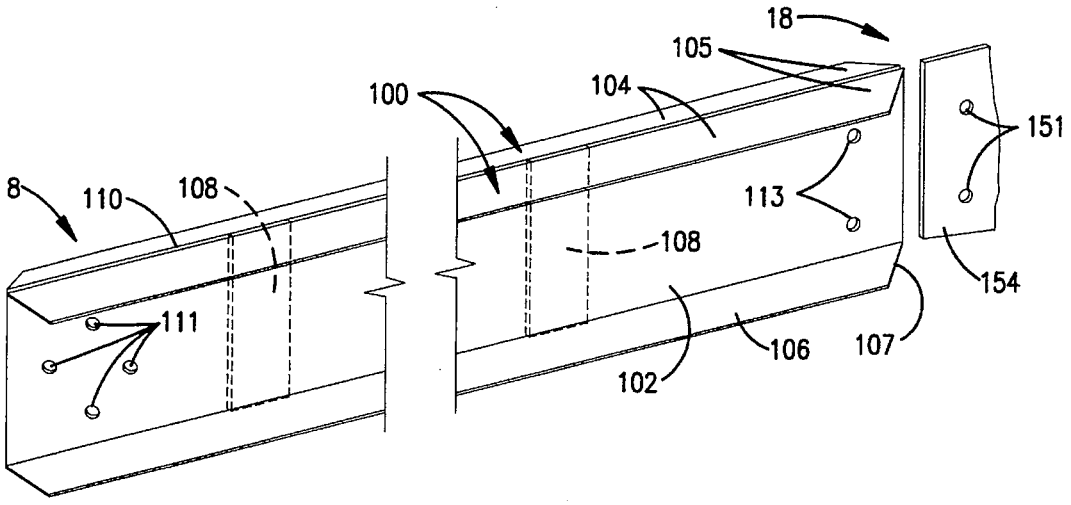
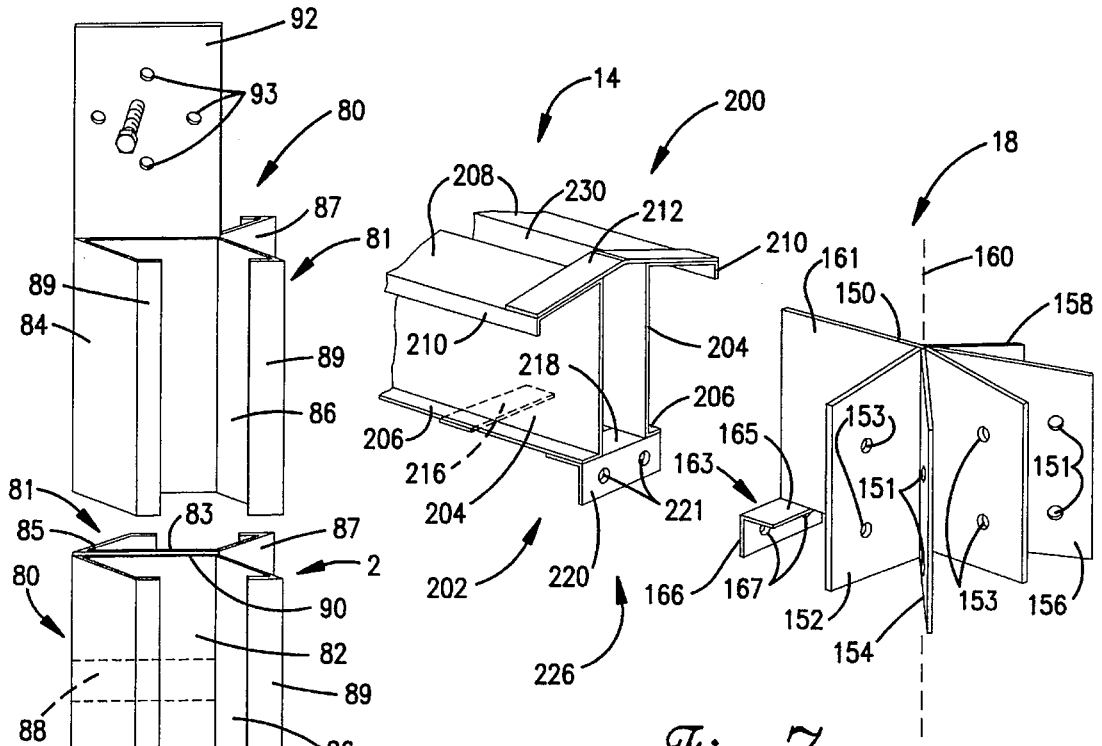
Fig. 7.
Fig. 3.

STEEL FRAME BUILDING

FIELD OF THE INVENTION

The present invention generally relates to a steel frame construction for a building, and more particularly to the vertical column and rafter design and the connectors and platforms used to attach the rafters and columns to one another and the foundation.

BACKGROUND OF THE INVENTION

In the past, a variety of systems have been proposed for constructing buildings.

For instance, U.S. Pat. No. 4,697,393 (Madray) discloses a metal building construction system including a plurality of inter-fitting components for general purpose building requirements. These components include side studs which are fastened to headers and joist through an cave adapter element. The joist are interconnected via a ridge adaptor. The cave adaptor and the ridge adaptor interconnect with channels of the studs, headers and joists. The framing studs are connected to the regular studs via L-shaped beams. The framing studs may be formed with a rolled edge which hooks over and engages a special piece of siding.

U.S. Pat. No. 4,688,358 (Madray) discloses a second building construction system which includes adapters for rapidly attaching girder members. The adapters are prefabricated with flanges to form at least two receiving channels of uniform width and cross-section. The channel members have a C-shaped cross-section and define studs and other building components. Studs, headers, and joist are connected through a plurality of ridge adapters and truss adapters. Floor joist are connected to the studs through cross adapters. A T-shaped adaptor provides a three-way connection between the floor joist and exterior wall studs. A cross adaptor provides a 4-way connection between floor joist and interior wall studs.

U.S. Pat. No. 4,551,957 (Madray) discloses a third building construction system having a plurality of substantially flat connector plate members for connecting girders, studs, and rafters. The girders, studs, and rafters are interconnected with connector plates to provide a wide range of framework members. Braces are included extending from the rafters to the girders. The stud members include a pair of reversely disposed channel members having webs secured together with spot welding. The channel members include flanges extending in opposite directions from the corresponding webs.

U.S. Pat. No. 4,809,480 (Hale) discloses a building metal support apparatus having vertical columns which support rafter members, girders, and roof support members. The vertical columns and the rafters are connected through rafter clips which include channel-shaped members and rafter plates that are welded to one another. The rafter clips are bolted to the support columns and the plates are bolted to the rafters. The rafters are connected to one another through joining plates which are welded to corresponding ends of the rafters. The vertical columns are connected to the base plate through base clips. The base plate rests on and can be fastened to the building's floor. The rafters, vertical columns, and girders generally are formed with a C-shaped cross-section while the roof support member is formed with a Z-shaped cross-section.

U.S. Pat. No. 1,258,408 (Hill) discloses a metallic building structure which attaches the column sections to the girders and the trusses with a horizontal plate member. The column section is connected to the girders or beams and the column sections through a plate member.

U.S. Pat. No. 1,893,636 (Ridgeway) discloses a metallic house frame which uses other types of connectors to interconnect the trusses, girders, and vertical support columns.

However, the foregoing systems have met with limited success since the connectors and frame design have failed to allow different types of rafters and ridge struts of differing shapes to be connected at a single point. Further, when the rafters, trusses, and beams of the conventional systems join, they intersect to form rough or discontinuous seams. These rough and unsmooth seams render it difficult to attach the siding and sheeting to the frame without creating gaps or unusual spans between the sheeting and the rafters, trusses, beams, and vertical support columns.

Additionally, the conventional systems form the beams and columns with universal connectors whereby any beam or column may be attached to one another. Hence, in the conventional systems, a builder was apt to accidentally connect a beam to an incorrect column.

A need remains in the industry for a steel frame structure which overcomes the foregoing problems. The present invention meets this need.

SUMMARY OF THE INVENTION

It is an object of the present invention to provide a frame structure containing connectors which are capable of connecting differently shaped beams to one another and to columns in a manner that provides smooth seams to receive sheeting without creating gaps or spans between the sheeting and frame.

It is another object of the present invention to provide a frame structure which is "idiot proof" to ensure that each connector, each rafter, each beam, and each column is attached to the correct component by pre-punching unique bolt patterns in each connector, beam, rafter, and column, such that only corresponding components are attached to one another. Unique patterns may also be achieved by varying the size and number of holes punched.

The foregoing objectives are achieved by providing a steel frame structure having base platform connectors which may be mounted on concrete pilings, which may join multiple floor rafters, and which may support compression ring beams. The platform connectors are also used to adjust floor height such as for use on hilly terrain. The platform connector receives structural beams from various directions to connect the floor rafters with the vertical frame and corner columns. Corner columns are connected to the top of the platform connectors located at the corners of the building. The corner columns are formed from vertical beams having a modified C-shaped cross-section to allow the sheeting to be attached directly to the outside and inside corners of the column without any additional structure. Each corner column includes two vertical beams affixed back-to-back with spacers therebetween. A knife plate projects from the top of each column and is received within a lower end of a rafter. Hip and valley rafters connect to the corner columns with predefined unique bolt patterns. The hip and valley rafters include support beams having a modified open C-shaped cross-section. Each support beam receives purlins which provide a flat surface on the top and bottom sides thereof for receiving sheeting. The hip and valley rafters include holes punched along the length thereof to receive flat head bolts to connect with the purlins. Main frame rafters and wall columns are provided between the hip and valley rafters and are formed from support beams having a straight C-shaped cross-section to receive the purlins and exterior studs. The straight structure of the columns allow the columns to fit into the exterior wall envelope. A ridge strut is provided along the peak of the structure and may be formed to allow for a ridge ventilator. A peak connector is located at the point of intersection between the rafters and ridge struts. The peak connector receives multiple components intersecting at various angles (corresponding to the differing pitches of the house). The peak connector combines the rafters and maintains smooth seams in order that sheeting may be connected along flat surfaces. The peak connector facilitates the erection of the rafter assembly through the use of unique pre-punched hole patterns. The peak connector facilitates assembly and assures that the structure will be square and plumb when all components are installed and tightened. Optionally, a pole may be attached to the peak connector to assure the proper peak height is attained. A wind column assembly is used when the structure is built in an area which will experience high winds to provide additional bracing. The wind column is placed on a large base plate and attached to a rigid frame column. The wind column fits within the exterior wall framing to remain invisible to the finished product when covered by sheeting.

BRIEF DESCRIPTION OF THE DRAWINGS

The objects and features of the invention noted above are explained in more detail with reference to the drawings, in which like reference numerals denote like elements, and in which:

FIG. 3 illustrates a perspective view of an outer corner column mounted upon a platform connector and supporting a hip rafter;

FIG. 7 illustrates a perspective view of a ridge strut and a peak connector.

DETAILED DESCRIPTION OF THE INVENTION

Figure 1:
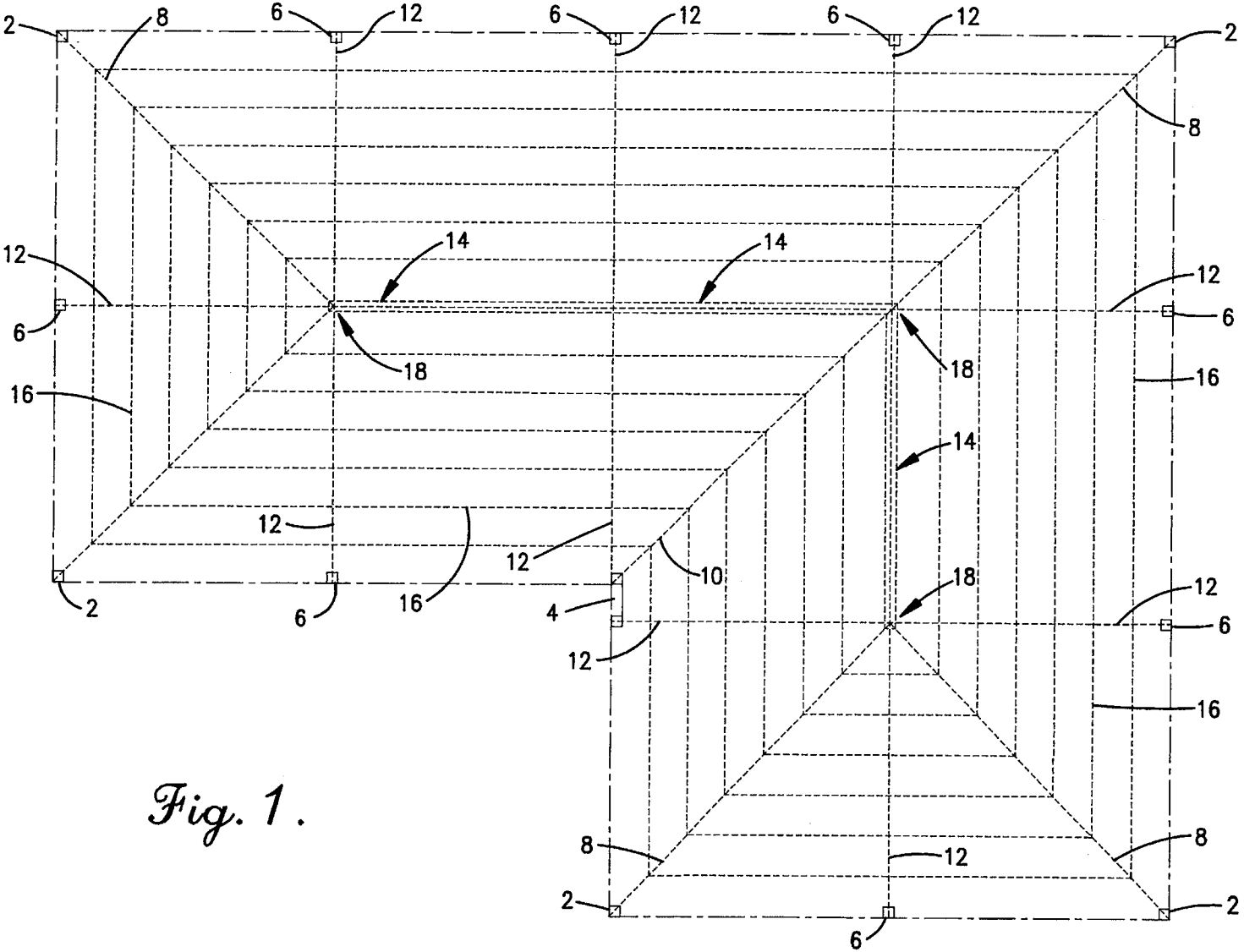
FIG. 1 illustrates a top plan view of a frame structure according to the present invention.

FIG. 1 generally illustrates a top plan view of an exemplary structure built with a frame according to the present invention. The top plan view of FIG. 1 is intended to generally illustrate the placement of each type of component. The dashed lines symbolize these components as explained hereafter.

Within the frame structure of FIG. 1, a plurality of rafters 8–12 are provided to define the various pitches and contours of the roof. These rafters include hip rafters 8 which define outer corners of the roof at intersections between adjacent outer sides of the roof. Valley rafters 10 are provided to define inner corners of the roof between adjacent inner sides of the roof. Main frame or jack rafters 12 are distributed evenly along the sides of the roof to define the pitch and to provide structural support. The upper ends of the hip, valley, and main frame rafters 8–12 join one another and are interconnected by peak connectors 18. The peak connectors are located at opposite ends of each ridge of the roof. The distance between the peak connectors 18 is spanned by ridge struts 14 extending along the summit of the roof.

A plurality of purlins 16 of differing lengths extend between adjacent rafters and are bolted thereto to afford lateral support for each rafter. This interconnecting arrangement ensures that adjacent rafters are maintained a desired distance from one another, while the purlin cross-sectional design and bolt pattern prevent the purlins from "twisting and rolling" about the connection points with the rafters.

Lower ends of each rafter are mounted upon vertical columns which afford vertical support for the frame structure. The columns are constructed from a plurality of configurations depending upon the placement of the column within the frame. These configurations ensure that each column provides a flat surface to receive sheeting. Outer corner columns 2 are located at each outer corner of the structure and inner corner columns 4 are located at the inner corners of the building. Wall columns 6 are located at intermediate points along each wall. The outer corner, inner corner and wall columns 2–6 support lower ends of the hip, valley, and main frame rafters 8–12, respectively. Optionally, the rafters may extend outward beyond the points of interconnection with the columns 2–6 to provide an overhang (not shown). Optionally, the overhang may be omitted with the columns 2–6 being located at the outer ends of the rafters 8–12.

Figure 2:
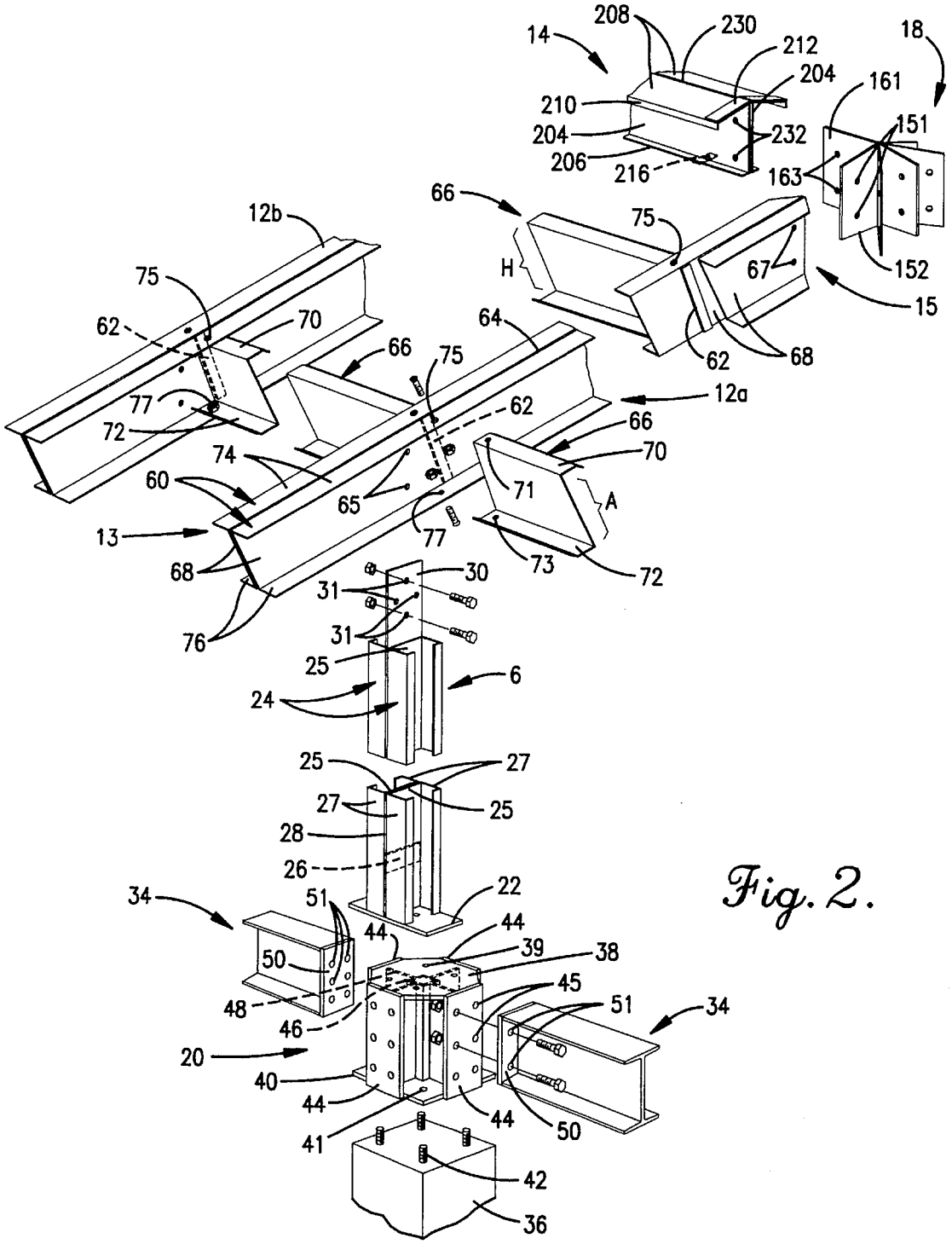
FIG. 2 illustrates a perspective view of a platform connector attached to floor joists and a wall column with the wall column connected to a main frame rafter, two purlins and a peak connector.

FIG. 2 illustrates a detailed perspective view of a wall column 6 mounted upon a platform connector 20 and supporting a main frame rafter 12. The wall column 6 is constructed with a base plate 22 securely mounted to lower ends of a pair of vertical support beams 24. Each support beam 24 includes a base wall 25 and leg flanges 27 combined to form a C-shaped cross-section. The leg flanges 27 project at approximately a right angle from the base wall 25. The support beams 24 are aligned in a back-to-back relation. The support beams 24 are spaced apart from one another via spacers 26 to maintain an air gap 28 therebetween. The spacers 26 are arranged at predefined intervals along the length of the support beams 24. The upper ends of the support beams 24 receive and are mounted to a knife plate 30 projecting from the air gap 28. The knife plate 30 includes a bolt hole pattern 31 therethrough. The knife plate 30 projects beyond the upper end of the support beams 24 to afford a surface which may be attached to the corresponding main frame rafter 12.

The base 22 includes a plurality of holes 32 punched therethrough in a pattern which aligns with a corresponding hole pattern in the top surface of the platform connector 20.

The platform connector 20 affords a common point for connecting a plurality of horizontal floor rafters or joists 34 with a wall column 6 and with a foundation piling 36. The platform connector 20 includes upper and lower face plates 38 and 40 aligned along parallel planes and having hole patterns 39 and 41 punched therethrough. The holes 41 in the lower face plate receive threaded rods 42 projecting upward and integrally formed within the concrete foundation pile 36. The upper and lower face plates 38 and 40 include peripheral edges that are secured to platform side mounting plates 44. The side mounting plates 44 may be oriented, as shown in FIG. 2, upon perpendicular axes extending through the center of the face plates. Optionally, the number and orientation of the mounting plates 44 may vary depending upon the configuration of the floor rafters 34. The side mounting plates provide support for the upper and lower face plates.

A core support bracket 46 is also centrally located between the upper and lower face plates 38 and 40 to provide additional structural support. In the preferred embodiment, the core support bracket 46 is constructed as a rectangular tube shaped segment. Optionally, flange supports 48 may be mounted between the upper and lower face plates 38 and 40 extending laterally between the support bracket 46 and the side mounting plates 44. The flange supports 48 are optional depending upon the amount of force that will be experienced by the platform connector 20.

Each floor rafter 34 represents a support beam and may include an I- or H-shaped cross-section. Opposite ends of the floor rafters 34 are provided with floor rafter mounting plates 50 which have a hole pattern 51 corresponding to the hole pattern 45 in the platform side mounting plates 44. Optionally, the floor rafter mounting plates 50 may be provided with a bolt pattern that aligns with a subset of the bolt pattern on the side plates 44, whereby the floor rafters may be vertically adjusted by sliding the floor rafter plate 50 up and down along the side plate 44 to align different sets of holes 45 and 51. This vertical adjustment affords compensation for height differences between adjacent platform connectors 20, such as on uneven ground.

As noted above, the upper end of the wall column 6 is attached to the lower end of a main frame rafter 12. As shown in FIG. 2, the rafter 12 is broken into two pieces to illustrate the lower end 13 which includes an overhang and the upper end 15 that is attached to a peak connector 18. Each main frame rafter 12 is constructed in a manner similar to the wall columns 6. In particular, each main frame rafter 12 includes two support beams 60 mounted in a back-to-back relation with one another. Each support beam 60 includes a back wall 68 with leg flanges 74 and 76 projecting outward at a right angle to provide a C-shaped cross-section The support beams 60 are separated, with spacers 62 to maintain an air gap 64 therebetween. Opposite ends of the support beams 60 include hole patterns 65 and 67 punched therethrough. The hole pattern 65 in the lower end of the support beam 60 is punched in a unique pattern that only aligns with the hole pattern 31 in the knife plate 30 on the wall column 6. The hole pattern in the lower end of the main frame rafter 12 is oriented such that the main frame rafter 12, when attached to the wall column 6, extends upward at a desired pitch (i.e., at an obtuse angle to the vertical axis of the frame rafter 12). In this manner, the hole patterns 65 and 31, when aligned, ensure that the rafter 12 is aligned at the proper pitch.

FIG. 2 further illustrates an end portion of a purlin 66 which is attached to the rafter 12*a* and extends laterally therefrom to be secured to an adjacent rafter 12*b*. Each purlin 66 may be constructed with a C-shaped cross-section or, as illustrated in FIG. 2, with a Z-shaped cross-section or with a similar structure so long as it provides upper and lower legs that may be secured to the rafters. Each purlin includes upper and lower legs 70 and 72 spaced a height H apart to fit snugly within the C-shaped section of the support beam 60. The end of the purlin 66 abuts against the back wall 68 of the beam 60, while the upper and lower legs 70 and 72 of the purlin 66 rest flush against the inner surfaces of the rafter's upper and lower flanges 74 and 76. The rafter's flanges 74 and 76 include corresponding holes 75 and 77 punched therein at predefined points along the length of the support beam 60. The 15 holes 75 and 77 align with corresponding holes 71 and 73 in the upper and lower legs 70 and 72 of the purlin 66. A plurality of purlins 66 are utilized to extend between adjacent rafters to provide lateral support for the frame structure. The interconnection and configuration of the purlins 66 and support beams 60 prevent the frame from collapsing in a scissor-like manner.

Turning to FIG. 3, a corner column 2 is illustrated, along with a hip rafter 8. The corner column 2 is constructed from a pair of vertical support beams 80 and 81, each of which includes a back section 82 and 83 and outer and inner flanges 84–87. As with the wall column 6, the support beams 80 and 81 are mounted in a back-to-back relation with one another and separated via spacers 88 to maintain a desired air gap 90. Outer edges of the flanges 84–87 include a rims 89 directed inward to provide additional support. The flanges upon each beam extend parallel to one another and at a non-perpendicular angle to the back section. This non-perpendicular angle is substantially dictated by the angle to be formed between adjoining walls connecting at the corner 2. For instance, when two adjoining walls form a 90° angle, the flanges 84–87 are constructed at a 45° angle with respect to the back sections 82 and 83. This 45° angular relation is maintained to ensure that, when the support beams 80 and 81 are mounted back-to-back, the pair of outer flanges 84 and 85 within a corner column form a 90° angle defining the corner of the building. Similarly, a pair of inner flanges 86 and 87 of a corner column form a 90° angle, when combined, to define the inner corner of the building.

The lower ends of the support beams 80 and 81 are fixedly mounted upon an L-shaped base plate 94. The base plate 94 includes a unique corner bolt/hole pattern 95 punched therethrough. The corner column 2 is mounted upon a platform connector 20*c* in a manner similar to that explained above in connection with FIG. 2. Reference numbers have been used in FIG. 3 to illustrate the platform connector which correspond to those of FIG. 2, except that each number has been followed by the letter "c" to denote that the connector corresponds to a corner connector. The base plate 94 and a corresponding platform connector 20*c* include holes punched therethrough in a unique corner hole pattern (39*c* and 95) corresponding to a corner combination. In this manner, corner connectors are provided with a unique bolt pattern which only aligns with the bolt pattern of a corresponding platform connector. Thus, a corner platform connector is not attachable to a non-corner column, such as a wall column. By maintaining unique bolt patterns between each type of platform connector and each type of column, the present system is able to ensure that the proper components are attached to one another.

FIG. 3 further illustrates the upper ends of the support beams 80 and 81 which receive a knife plate 92 fixedly mounted therebetween. The knife plate 92 projects upward from the support beams and includes a hole pattern 93 therethrough which align with corresponding holes in a hip rafter 8. The knife plate 92 interconnects the corner column 2 and hip rafter 8.

The hip rafter 8 includes support beams 100 mounted in a back to back relationship with one another. Each support beam includes a back wall 102 and parallel upper and lower flanges 104 and 106. The flanges are mounted to the back wall 102 at a non-perpendicular angle, with the upper flange 104 being directed downward and forming an acute angle with the back wall 102. The upper and lower flanges extend parallel to one another downward away from the top edge 103 of the back wall 102 at an angle corresponding to the angle at which the roof falls away from the hip rafter 8. The flanges 104 extend substantially parallel to, and in the plane of, the corresponding sections of the roof, in order that sheeting placed upon the rafters lays flat upon the flanges 104. The upper ends 105 and 107 of the flanges 104 and 106 are beveled at substantially a 45° angle with respect to the longitudinal axis of the support beams 100. As explained below in connection with FIG. 6, the beveled upper ends enables the hip rafter 8 to be smoothly aligned in an abutting relation with upper ends of adjacent rafters when converged at the peak connector 18.

As with the previous rafter, the support beams 100 are spaced apart from one another by spacers 108 to maintain an air gap 110 therebetween. The spacers are disposed at intermediate points along the length of the beams 100 to provide support. The lower end of each hip rafter 8 includes a unique hole pattern 111 punched therethrough which only aligns with the hole pattern 93 in the knife plate 92 of any outer corner column 2. The hole pattern 111 within the hip rafter 8 is oriented at an angle to the longitudinal axis of the support beams 100, such that, when the hole patterns 111 and 93 align, the rafter 8 projects upward at the desired pitch. The upper end of the hip rafter 8 similarly includes a unique hole pattern 113 through the support beams 100. The hole pattern 113 in the upper end of the rafter 8 corresponds to a unique hole pattern 151 in one arm of the peak connector 18 as explained below in connection with FIG. 7.

As with the main frame rafters 12, the hip rafters 8 include a plurality of purlin receiving holes (not shown) punched in the upper and lower flanges 104 and 106 along a length thereof. The support beams 100 receive corresponding purlins at an angle to the axis thereof, with upper and lower legs of the purlins aligning flush against the inner sides of the flanges 104 and 106, The purlins are bolted to the flanges 104 and 106 as explained above to provide lateral support for the hip rafters 8.

Figure 4:
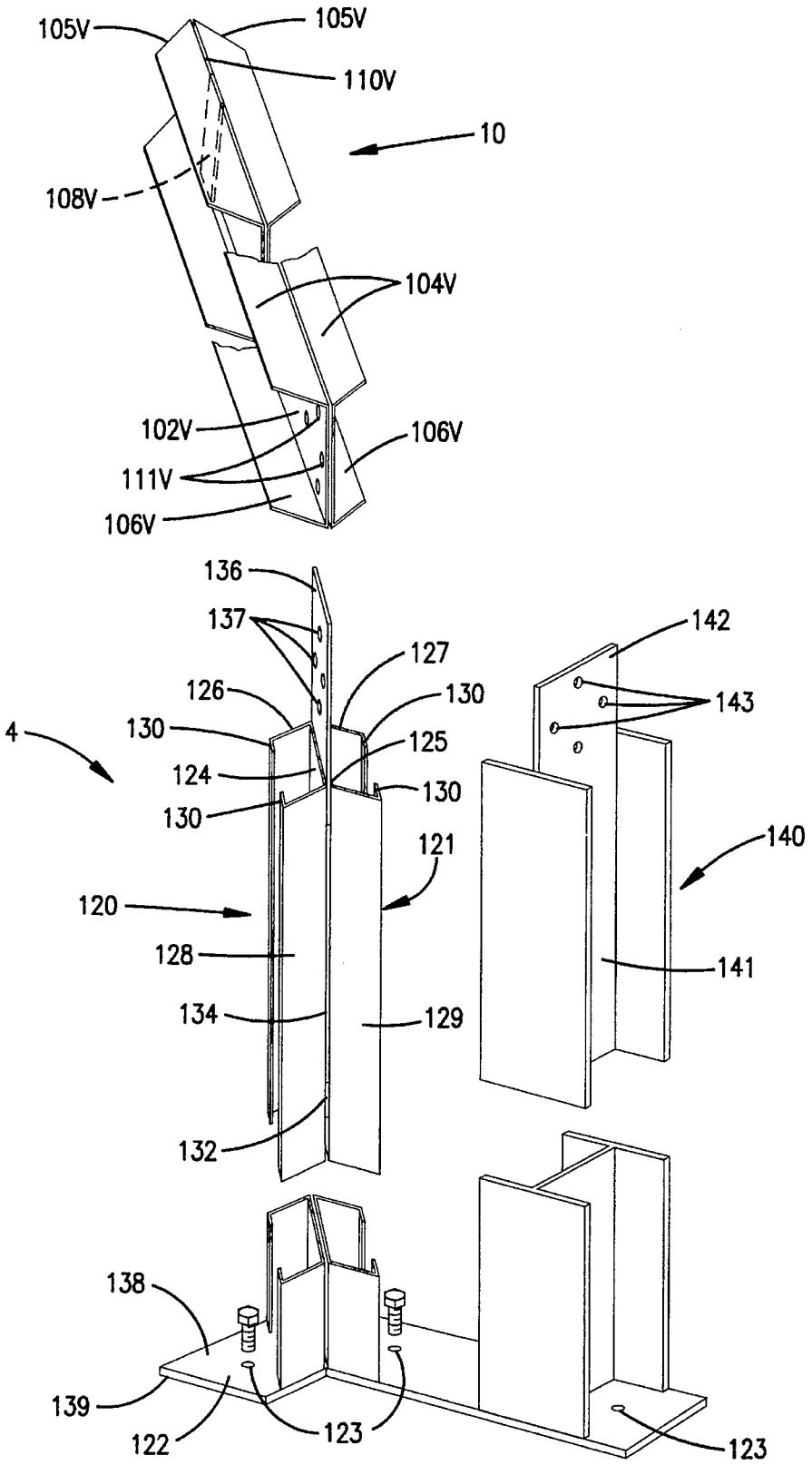
FIG. 4 illustrates a perspective view of an inner corner column mounted upon a base adjacent a second type of wall connector with the inner corner column supporting a valley rafter.

Turning to FIG. 4, an inner corner column 4 is illustrated along with a valley rafter 10. The inner corner column 4 includes support beams 120 and 121 projecting upward from a base 122. The base 122 is constructed in an L-shape. The support beams are constructed similar to those of an outer corner column and include back walls 124 and 125, each of which is attached to corresponding inner and outer flanges 126–129. The inner and outer flanges of corresponding beams 120 are aligned parallel to one another and form an acute angle with the corresponding back wall. Optionally, the outer tips of the flanges 126–129 may include flared rims 130 directed inward to provide additional support. The support beams 120 are aligned in a back to back relation and spaced apart from one another with spacers 132 to maintain a predetermined air gap 134 therebetween. The upper ends of the support beams 120 receive a knife plate 136 therebetween in a mounted and fixed relation. The knife plate includes a hole pattern 137 punched therethrough which align with a corresponding hole pattern in the lower end of the valley rafter 10.

The base plate 122 includes a hole pattern 123 punched therethrough which aligns with a corresponding hole pattern in an inner corner platform connector (not shown). When the base plate 22 is bolted to the corresponding inner corner platform connector, outer edges 138 and 139 of the base 122 are aligned in a planar relation with the outer surfaces of the platform side mounting plates (44 and 44*c* shown in FIGS. 2 and 3).

The valley rafters 10 are constructed in a manner substantially similar to the hip rafters 8, except that the upper and lower flanges are directed upward in a direction opposite to the downward direction of the flanges on a hip rafter. The components of the valley rafter have been labeled with reference numbers denoted upon the hip rafter of FIG. 3, except that the letter "v" follows each number to indicate that the component corresponds to a valley rafter. Opposite ends of the valley rafter include unique hole patterns punched therethrough. The holes in the lower end of the valley rafter align with the hole pattern 137 in the knife plate 136 such that, when bolted in position, the valley rafter projects upward at a desired pitch corresponding to the pitch of the roof. The upper end of the valley rafter includes a unique hole pattern that is bolted to an arm of the roof connector 18 as explained below.

As illustrated in FIG. 4, a second vertical support 140 is mounted upon the base plate 122. The second vertical support 140 is constructed with an I-beam cross-section, with the upper and lower limbs of the I-beam aligned parallel to and flush with the inner and outer walls of the building. These limbs receive inner and outer sheeting. At the upper end of the I-beam, the central wall 141 of the I-beam projects upward beyond the inner and outer limbs to form a knife plate 142. The knife plate 142 is bolted to a lower end of a main frame rafter located adjacent the lower end of the valley rafter 10. The knife plate 142 includes a hole pattern 143 therein which corresponds to that of a main frame rafter (as explained above in connection with FIG. 2).

Figure 5:
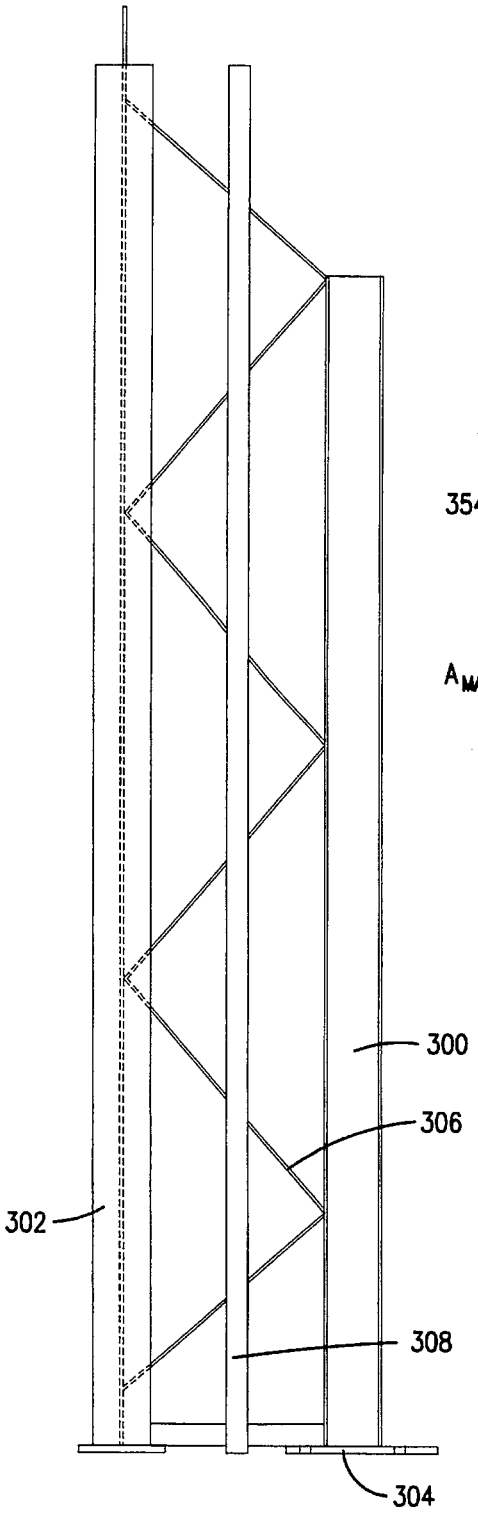
FIG. 5 illustrates a side view of an additional support beam for use in winding conditions.

FIG. 5 illustrates an additional support structure which may be attached to one or more corner and wall columns, such as in areas that experience excessive winds. To enhance the overall structured a separate I-beam 300 is located adjacent a vertical column 302 (i.e., a corner or wall column). The I-beam 300 is mounted upon a separate base 304 and (optionally) a separate platform connector (not shown). A plurality of cross-tie bands 306 are affixed between the I-beam 300 and the column 302. The bands 306 are arranged in a zig-zag pattern and are sandwiched between and mounted to vertical bars 308.

Turning to FIG. 7, a peak connector 18 is illustrated in more detail. The peak connector 18 includes a rectangular central plate 150 projecting along the central vertical axis 160 of the connector. A plurality of side plates 152–158 are securely mounted to and project laterally outward from the center plate 150 at a longitudinal axis 160. The peak connector 18 is located at a point whereat the center and side plates 150–158 receive the upper ends of a plurality of rafters. The center and side plates 150–158 project outward from the central vertical axis 160 at differing angles dependent upon the angle at which a related rafter is received. Each of the plates 150–158 includes a unique type of bolt/hole pattern therein corresponding to the type of rafter to be received. In particular, the plates 154 and 156 receive hip rafters 8 and thus include a unique type of bolt/hole pattern 151 specifically defined for the upper end of hip rafters. All hip rafters include this hip rafter bolt/hole pattern 151 and thus will align properly with the plates 154 and 156. Similarly, the plates 152 and 158 and the outer end of the center plate 150 receive main frame rafter 10. Thus, the plates 152 and 158 include a main frame rafter bolt/hole pattern 153 which aligns with main frame rafters.

Figure 6:
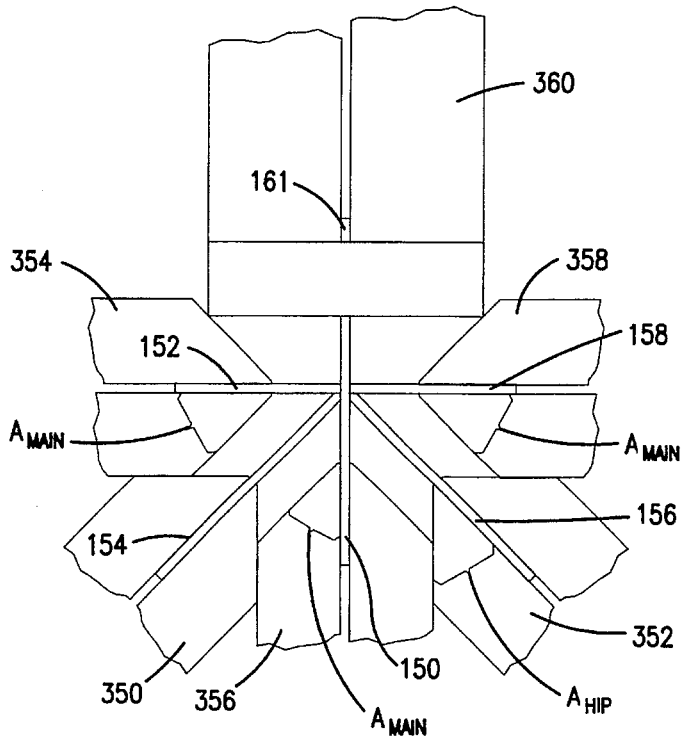
FIG. 6 illustrates a top plan view of the peak connector as attached to multiple rafters and a ridge strut.

FIG. 6 illustrates a top plan view of a peak connector attached each type of rafter. The peak connector 18 includes a center plate 150 having an outer end received within a main frame rafter 356. Side plates 154 and 156 are received within hip rafters 350 and 352, respectively. Side plates 152 and 158 are received within main frame rafters 354 and 358, respectively. A rear end 160 of the center plate is received within a ridge strut 360. Each of the plates are bolted to the corresponding rafter and strut. As shown in FIG. 6, the hip and main frame rafters 350–358 are retained in an abutting relation with one another. Interference is minimized between adjacent rafters by providing beveled edges thereon. In particular, the main frame rafters 354, 356, and 358 are formed with beveled edges 355, 357 and 359, respectively, along an angle Again equalling the angle formed between the adjacent plates. In FIG. 6, the bevel angle $A_{main}$ equals substantially 45°. The hip rafters 350 and 352 also include a beveled upper end cut at an angle $A_{hip}$ which also corresponds to the angle between adjacent plates (e.g., 45°). As shown in FIG. 6, the main frame rafters project further into the peak connector than the hip rafters which, optionally, abut against the sides of the main frame rafters. Optionally, the hip rafters may project further into the peak connection that the main frame rafters. As a further alternative, the hip and main frame rafters may project the same distance into the inter-connection with the beveled edges upon adjoining rafters spaced apart or abutting against one another. The bolt patterns upon the plates 150–158 and the rafters 350–358 are aligned such that the flanges of each rafter evenly meet the flanges of adjacent rafters to provide a smooth transition therebetween.

While the ridge strut is illustrated without a beveled edge, optionally the ridge strut 360 may be provided with the same type of beveled end as upon the rafters in order that the strut 360 will better fit within the peak connection.

As illustrated in FIG. 6, the rafters are formed with wedge shaped upper ends to combine in a pie shape when attached to the corresponding plates within the peak connector 18. When so attached, the peak connector 18 aligns adjacent rafters, such that the upper flanges thereof meet to form a continuous smooth seam. By aligning the upper flanges upon adjacent rafters in this manner, a smooth transitional surface is provided between adjoining rafters upon which sheeting may be attached. The bolt patterns within the peak connector and the rafters are pre-punched to properly align the rafters in this manner. It is to be understood that the seams between adjacent rafters do not necessarily form planar intersections. Instead, the seam may represent a ridge or a valley. Regardless of the angle formed between adjoining flanges upon adjacent rafters, the peak connector maintains smooth seams between such flanges.

FIGS. 2 and 7 illustrate alternative embodiments for the peak connector 18, between which the rear end 161 of the central plate 150 is varied depending upon the type of ridge strut 14 utilized. In the embodiment of FIGS. 2 and 6, the rear end 161 of the peak connector simply includes an elongated knife plate somewhat longer than the plates 152–158. This rear end knife plate 161 is extended to attach to the ridge strut 14 at a position remote from the intersecting point of the plates 152–154. By remotely attaching the ridge strut 14 in this manner, the peak connector 18 prevents the ridge strut 14 from interfering with the rafters attached to the adjacent plates 152 and 158.

The peak connectors 18 align joining ends of the rafters and struts 8–14 to maintain smooth intersecting seams therebetween. The peak connector 18 is located at the point at which all of the rafters and ridge struts 8–14 combine. This point represents a very busy intersection which must receive sections of the roof at a plurality of angles and shapes. By maintaining this smooth interconnection, the peak connector 18 renders easy installation of the sheeting. Once the holes in the connector 18 and rafters are aligned and bolts are inserted, the rafter assembly may be erected easily and virtually assured that the structure will be square and plumb. Optionally, a "story pole" may be used to locate the peak connector 18 at the proper height.

FIG. 2 illustrates a ridge strut 14 constructed with two support beams 200 and 202 mounted to one another in a back to back relation. Each support beam includes a vertical wall 204 with a lower leg 206 mounted thereto and projecting outward therefrom at a 90° angle. Each wall 204 is further attached to a ceiling 208 projecting outward therefrom at an acute angle. The outer edge of the ceiling 208 further includes a rim 210 extending along its length. The walls 204 of adjacent support beams are spaced apart from one another by spacer clips 212 to maintain an air gap 214 therebetween. The spacer clips 212 are constructed as V-shaped clips which mount upon the top surfaces of the ceilings 208. Flat clips 216 are further attached to the bottom surfaces of the lower legs 206 to equally maintain the air gap 214. The clips 212 and 214 are distributed along the support beam as necessary for support. The support beams are spaced a shorter distance apart from one another to maintain a narrower air gap 230 therebetween.

The ridge strut 14 is attached to the extended rear plate 161 by aligning holes 163 with holes 232. The air gap 230 substantially corresponds to the outer width of the rear end knife plate 161. In both embodiments, the peak connector 18 maintains the ridge strut 14 at a distance remote from the interconnecting point of the rafters to prevent interference therewith.

Alternatively, as illustrated in FIG. 7, the rear end 161 of the central plate 150 may be modified by providing a shorter plate with an L-shaped bracket or "angle iron" 163. The bracket 163 includes a supporting leg 165 which is secured to the lower edges of one or more of the plates 150–158 and an opposite perpendicular leg forming a mounting face 166 which is bolted to a corresponding face on the ridge strut 14.

The ridge strut illustrated in FIG. 7 resembles that of FIG. 2, except that the clips 212 and 218 have been lengthened to widen the air gap 230 (such as for a ventilator). The ridge strut of FIG. 7 further includes an L-shaped bracket 226 or angle irons located at opposite ends of the support beams and mounted to the lower surfaces of the lower leg 206. The bracket 226 includes a support leg 218 mounted to the lower legs 206 and a perpendicular leg forming an outer mounting face 220 with holes 221 therein. The holes 221 align with the holes 167 in the bracket on the connector 18, to afford an interconnecting bracket when the mounting faces 220 and 166 are abutted against one another. In this manner, the brackets 163 and 226 afford an interconnecting means to attach the ridge strut 14 to the peak connector 18. In this embodiment, the clips 212 and 216 maintain the support beams 200 and 202 a substantial distance apart from one another to afford a ventilation air gap 230 therebetween.

The upper ends of the back sections of the hip and valley rafters 8 and 10 are cut along a beveled angle with respect to the longitudinal axis of the support beams. This beveled angle substantially corresponds to the pitch at which the rafter is to be maintained. This beveled angle ensures a proper alignment with the peak connector 18 when the corresponding holes are aligned with one another.

Optionally, the columns and rafters may be reversed to permanently mount the knife plate to the rafters and providing a corresponding bolt pattern in the support beams of the columns. In this alternative, the knife plate would be bolted to the column during construction.

It should be understood that unique hole patterns are used with each type of connection, not every single connection. Thus, all similar outer corner columns and all outer corner platform connectors have the same hole pattern. Similarly, all inner corner columns and inner corner platform connectors have the same hole pattern. All wall columns and wall column platform connectors have the same hole pattern and the like.

From the foregoing it will be seen that this invention is one well adapted to attain all ends and objects hereinabove set forth together with the other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative, and not in a limiting sense.

What is claimed is:

1. A building frame structure erected upon a foundation, comprising:

a plurality of vertical corner columns outside corners of the structure at a juncture of adjoining walls wherein each of said corner columns comprises a pair of corner column support beams, said corner column support beams each including a vertically extending back section having inner and outer flanges projecting from opposite sides thereof parallel to one another, said column support beams being aligned such that the back sections of each pair of column support beams are positioned in back to back relation with one another and wherein the outer flanges of each pair of corner column support beams together form an angle with one another corresponding to the angle of the corner formed between adjoining walls of the structure;

a plurality of hip and valley rafters, extending upward from corresponding vertical corner columns adapted to support a roof of the structure, said hip and valley rafters adapted to define a pitch of said roof at corners between adjoining sections of the roof, each of said rafters including a pair of rafter support beams, wherein each of the rafter support beams includes a back section having upper and lower flanges projecting from opposite sides thereof parallel to one another said rafter support beams being aligned such that the back sections of each pair of rafter support beams are positioned in back to back relation with one another and wherein the upper flanges of each pair of rafter support beams are adapted to project from the corresponding back wall at an angle corresponding to the angle at which the roof is intended to fall or rise away from the hip or valley rafter respectively;

a plurality of knife plates for interconnecting corresponding vertical corner columns and hip and valley rafters, each knife plate being fixedly received between upper ends of the column support beams of the corresponding corner column and lower ends of the rafter support beams of the corresponding hip or valley rafter; and a plurality of purlin beams extending between adjacent hip and valley rafters to provide lateral support for the frame structure, said purlin beams being secured to said hip and valley rafters within the confines of said upper and lower flanges of the rafter support beams.

2. A building frame structure erected upon a foundation according to claim 1, wherein said knife plate includes a lower end that is fixedly mounted between the column support beams and an upper end having a unique corner bolt pattern therein, said lower end of said rafter support beams having a corresponding unique corner bolt pattern, said corner bolt patterns aligning to receive bolts for attaching said knife plate to said rafter.

3. A building frame structure erected upon a foundation according to claim 1, further comprising:

a plurality of vertical wall columns located at intermediate points along walls of the structure between the corner columns, said wall columns comprising a pair of wall column support beams each having a back section with outer and inner flanges projecting from opposite sides thereof parallel to one another, wherein the wall columns are aligned such that the back sections of each pair of wall column support beams are in back to back relation with one another, and wherein the outer flanges of each pair of wall column support beams together provide a planar surface parallel to the surface of a corresponding wall;

an equal plurality of main frame rafters extending upward from corresponding wall columns adapted to support a roof of the structure, said main frame rafters adapted to define a pitch of said roof within sections of the roof, each of said main frame rafters including a pair of main frame rafter support beams, wherein the main frame rafter support beams each include a back section having upper and lower flanges projecting from opposite sides thereof parallel to one another, said main frame rafter support beams being aligned such that the back sections of each pair of main frame rafter support beams are positioned in a back to back relation with one another and wherein the upper flanges of each main frame rafter support beam are adapted to project from the back section at a right angle parallel to the roof;

an equal plurality of knife plates for interconnecting corresponding wall columns and main frame rafters, each knife plate being fixedly received between upper ends of the wall column support beams of the corresponding wall column and lower ends of the main frame rafter support beams of the corresponding main frame rafter; and a plurality of purlin beams extending between adjacent main frame rafters adapted to provide lateral support for the frame structure, said purlin beams being secured to said main frame rafters within the confines of said upper and lower flanges of the rafter support beams.

4. A building frame structure erected upon a foundation according to claim 3, said structure additionally comprising:

horizontal base plates on the lower ends of said corner columns and said wall columns, said base plates having unique corner and wall column bolt patterns punched therethrough;

a plurality of horizontal floor joists adapted to support a floor of the structure; and a plurality of platform connectors, mounted upon the foundation at predefined points thereabout, said platform connectors providing support for, and a common point of connection for floor joists and corner and wall columns, said platform connector including an upper face plate having a unique bolt pattern corresponding to one of said corner and wall column bolt patterns, wherein platform connectors located at corners of the structure having a corner column bolt pattern corresponding to the bolt pattern in a corner column and wherein platform connectors located along the walls of the structure have a different wall column bolt pattern corresponding to the bolt pattern in a wall column.

5. A building frame structure according to claim 4, further comprising side mounting plates mounted upon sides of the upper face plate for securely receiving ends of floor joists, said plates being oriented upon perpendicular axes extending through the center of the face plates.

6. A building frame structure according to claim 4, further comprising:

a lower face plate securely mounted upon the foundation; and a core support bracket centrally located between the upper and lower face plates to provide additional structural support, said core support bracket being constructed as a rectangular tube shaped segment.

7. A building frame structure erected upon a foundation according to claim 3, wherein said purlin beams include upper and lower legs spaced a height apart to fit snugly between said upper and lower flanges of the corresponding hip and valley main frame rafter support beams.

8. A building frame structure erected upon a foundation according to claim 7, wherein said upper and lower legs of said purlin beams rest flush against inner faces of said upper and lower flanges of the corresponding hip and valley main frame rafter support beams.

9. A building frame structure erected upon a foundation according to claim 1, wherein said outer and inner flanges of the corner column support beam project from the back section at a non-perpendicular angle to the back section.

10. A building frame structure erected upon a foundation according to claim 1, wherein each corner column support beam includes a back section with outer and inner flanges projecting from opposite sides thereof, and wherein outer flanges for a pair of corner column support beams form a right angle with one another corresponding to a right angle formed between adjoining walls of the structure.

11. A building frame structure erected upon a foundation according to claim 10, wherein the back sections of each pair of corner column support beams are aligned in a back-to-back relation with one another such that the back sections are positioned at a 45° angle from each of said adjoining walls of the structure and wherein said outer flanges for each pair of corner column support beams project from the corresponding back section at a 45° angle from the corresponding back section to form a 90° angle between the outer flanges of the pair of corner column support beams.

12. A building frame structure erected upon a foundation according to claim 1, wherein the corner columns form studs adapted to support side sheeting wherein said side sheeting is intended to be attached directly to said outer flanges as corner column support beams.

13. A building frame structure erected upon a foundation according to claim 1, wherein the corner columns include inner and outer flanges extending parallel to corresponding walls of the structure, said flanges adapted to have inner and outer side sheeting attached directly thereto.

14. A building frame structure erected upon a foundation according to claim 1, wherein said hip rafter includes hip rafter support beams having upper and lower hip flanges extending outward and downward from said hip rafter support beam at an acute angle.

15. A building frame structure erected upon a foundation according to claim 1, wherein said valley rafter includes valley rafter support beams having upper and lower valley flanges extending outward and upward from said valley rafter support beam at an obtuse angle.

16. A building frame structure erected upon a foundation, according to claim 1, wherein at least two or more of said rafters converge to form a peak and wherein the structure additionally comprises:

at least one peak connector, aligned along a vertical axis and located proximate said peak at a point of convergence of said at least two or more of said rafters, said peak connector including multiple knife plates extending laterally outward from said vertical axis, each of said knife plates being received between and affixed to rafter support beams of a corresponding rafter.

17. A building frame structure erected upon a foundation according to claim 16, wherein each of said knife plates of the peak connector extends parallel to said vertical axis and wherein adjacent knife plates are mounted with a predetermined angle therebetween, said predetermined angle being equal to an angle formed between longitudinal axes of corresponding adjacent rafters affixed to said knife plates.

18. A building frame structure erected upon a foundation according to claim 16, wherein each of said knife plates is bolted to a corresponding rafter, each knife plate including a unique bolt pattern therethrough corresponding to a similar bolt pattern through an upper end of the rafter support beams associated with said knife plate.

19. A building frame structure erected upon a foundation according to claim 16, wherein said peak connector further includes a rectangular central plate extending through the vertical axis and multiple side plates affixed to said central plate proximate said vertical axis, and an L-shaped bracket having a supporting leg secured to lower edges of the center plate and multiple side plates, said bracket including an opposite leg projecting downward perpendicular to said supporting leg, said opposite leg forming a mounting face.

20. A building frame structure erected upon a foundation according to claim 16, further comprising:

a ridge strut, adapted to extend along a summit of the roof, for providing lateral support between adjacent peak connectors, said strut including two support beams mounted to one another in a back to back relation, each support beam including a vertical wall with a lower leg mounted thereto and projecting outward therefrom at a right angle and a ceiling projecting outward therefrom at an acute angle.

21. A building frame structure erected upon a foundation according to claim 20, wherein the walls of adjacent support beams are spaced apart from one another by spacer clips to maintain an air gap therebetween corresponding in width to a width of said central knife plate in said peak connector.

22. A building frame structure erected upon a foundation according to claim 1, wherein said purlin beams include upper and lower legs spaced a height apart to fit snugly between said upper and lower flanges of the corresponding hip or valley rafter support beams.

23. A building frame structure erected upon a foundation according to claim 22, wherein said upper and lower legs of said purlin beams rest flush against inner faces of said upper and lower flanges of the corresponding hip and valley rafter support beams.

24. A building frame structure erected upon a foundation wherein the frame structure provides a seamless and continuous roof line, said structure comprising:

a plurality of vertical corner columns located at the outside corners of the structure and at one or more junctures of adjoining walls wherein each of the corner columns includes a pair of corner column support beams, said corner column support beams each including a vertically extending back section having inner and outer flanges projecting from opposite sides thereof which are aligned parallel to one another, said column support beams being positioned such that the back sections of each pair of corner column support beams are aligned in back-to-back relation with one another and wherein the outer flanges of each pair of corner column support beams together form an angle with one another corresponding to the angle formed at the outside corner or juncture of adjoining walls, wherein said outer flanges are adapted to provide a surface upon which said walls may be supported;

a plurality of hip and valley rafters extending upward from corresponding vertical corner columns adapted to support a roof of the structure, said hip and valley rafters adapted to define a pitch of the roof at corners between adjoining sections of the roof, wherein each of the rafters includes a pair of rafter support beams, each of the rafter support beams including a back section having upper and lower flanges projecting from opposite sides thereof which are parallel to one another, said rafter support beams being positioned such that the back sections of each pair of rafter support beams are aligned in back-to-back relation with one another and wherein the upper flanges of each pair of rafter support beams are adapted to project from the back wall at an angle corresponding to the angle at which the roof is intended to fall or rise away from the corresponding hip or valley rafter respectively, wherein said upper flanges provide an upper surface adapted to support the roof;

a plurality of vertical wall columns located at intermediate points between the corner columns, wherein said wall columns comprise a pair of wall column support beams each having a back section with outer and inner flanges projecting from opposite sides thereof parallel to one another, said wall columns being positioned such that the back sections of each pair of wall column support beams are in back-to-back relation with one another, and wherein the outer flanges of each pair of wall column support beams together provide a planar surface parallel to the surface of a corresponding wall, said outer flanges of said wall column support beams providing a surface upon which said corresponding wall may be supported;

a plurality of main frame rafters extending upward from corresponding wall columns adapted to support roof of the structure, said main frame rafters adapted to define a pitch of said roof within sections of the roof, each of said main frame rafters including a pair of main frame rafter support beams wherein the main frame rafter support beams each include a back section having upper and lower flanges projecting from opposite sides thereof which are aligned parallel to one another, said main frame rafter support beams being positioned such that the back sections of each pair of main frame rafter support beams are aligned in a back-to-back relation with one another and wherein the upper flanges of each main frame rafter support beam project from the back section at a right angle, wherein said upper flanges of said main frame rafter support beams are adapted to provide a surface upon which the roof may be supported; and a plurality of purlin beams extending between adjacent rafters to provide lateral support for the frame structure, wherein said purlin beams are secured to said rafters within the confines of the upper and lower flanges of the corresponding rafter support beams.

* * * * *